US008800092B1

(12) United States Patent
Morad et al.

(10) Patent No.: US 8,800,092 B1
(45) Date of Patent: Aug. 12, 2014

(54) APPARATUS TO REMOVE A DISPOSABLE CLOTH FROM A HAND OPERATED FLAT MOP THROUGH A SINGLE TRIGGER MECHANISM WITHOUT HAVING TO TOUCH THE DISPOSABLE CLOTH

(71) Applicants: Fred I. Morad, Toluca Lake, CA (US); William P. Camp, Jr., Vanlue, OH (US)

(72) Inventors: Fred I. Morad, Toluca Lake, CA (US); William P. Camp, Jr., Vanlue, OH (US)

(73) Assignee: Worldwide Integrated Resources, Inc., Montebello, CA (US)

( * ) Notice: Subject to any disclaimer, the term of this patent is extended or adjusted under 35 U.S.C. 154(b) by 0 days.

(21) Appl. No.: 13/933,455

(22) Filed: Jul. 2, 2013

(51) Int. Cl.
*A47L 13/256* (2006.01)
*A47L 13/254* (2006.01)

(52) U.S. Cl.
USPC ..... 15/147.1; 15/147.2; 15/228

(58) Field of Classification Search
None
See application file for complete search history.

(56) References Cited

U.S. PATENT DOCUMENTS

2011/0023251 A1* 2/2011 Bober et al. ..... 15/228

* cited by examiner

*Primary Examiner* — Monica Carter
*Assistant Examiner* — Stephanie Berry
(74) *Attorney, Agent, or Firm* — Thomas I. Rozsa

(57) ABSTRACT

A single trigger mechanism to release a disposable microfiber cloth or non-woven cloth from a flat mop. There are three major components of the present invention: (1) a top plate; (2) a mechanical plate; and (3) a push plate.

3 Claims, 20 Drawing Sheets

APPARATUS TO REMOVE A DISPOSABLE CLOTH FROM A HAND OPERATED FLAT MOP THROUGH A SINGLE TRIGGER MECHANISM WITHOUT HAVING TO TOUCH THE DISPOSABLE CLOTH

BACKGROUND OF THE INVENTION

1. Field of the Invention

The present invention relates to the field of hand operated flat mops which retain a disposable cleaning cloth used to scrub and clean surfaces such as floors.

2. Description of the Prior Art

Hand operated flat mops which retain a disposable cleaning cloth are known in the prior art. However, one problem with prior art hand operated flat mops is that a dirty cloth needs to be touched by hand in order to be released from the mop and discarded into a waste receptacle.

There is a significant need for an improved hand operated flat mop which eliminates the necessity to touch a dirty cleaning cloth by hand to discard it into a waste receptacle.

SUMMARY OF THE INVENTION

The present invention is a single trigger mechanism to release a disposable microfiber cloth or non-woven cloth from a flat mop. There are three major components of the present invention: (1) a top plate; (2) a mechanical plate; and (3) a push plate.

The top plate is strictly stationary. It has a flat top surface with a yoke member which rotatably supports a handle so as user can push the microfiber flat mop in a back-and-forth direction with the handle that goes into the collar. The top housing encloses a trigger mechanism.

The mechanical plate is sandwiched between the top plate and the push plate which retains the cloth in one or two alternative embodiments so that the cloth can be removed after it is dirty and disposed of without a hand having to touch the cloth.

The push plate is used to retain the microfiber cloth or non-woven cloth and when a trigger mechanism is activated, force springs cause the push plate to be removed from its press fit against the mechanical plate so that dirty microfiber cloth is released and can be disposed of without a person's hand having to touch the dirty microfiber cloth.

It is an object of the present invention to provide of mechanism to retain a microfiber cloth or non-woven cleaning cloth on the hand operated flat mop in a manner which enables the cleaning cloth to be released and discarded after it is dirty from being used over a period of time to clean a surface such as a wall.

It is also an object of the present invention to incorporate a single release trigger mechanism by which teeth inserted into a notch of a ratchet collar which overcome the downward force of force springs to be released so that the downward force of the force springs cause the push plate retaining the microfiber cloth against a middle mechanical plate to move away so that the dirty cloth can be removed.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

The new innovation has a single trigger mechanism to release the disposable microfiber cloth or non-woven cloth from a flat mop. This is also applicable to a microfiber mop. It has a single trigger release mechanism. The mop may have a yoke which rotatably retains a handle above a housing which retains the retained the trigger mechanism, or the mop can have a handle retaining mechanism without a yoke.

Essentially there are three major components that have been described. The first component is a top plate. The second component s is a mechanical plate. The third component is a push plate.

With respect to the top plate, the top plate is strictly stationary. It has a flat top surface with a yoke which rotatably restrains a handle so a user can push the microfiber flat mop in a back-and-forth direction with the handle that goes into the collar in the yoke. The top housing encloses a trigger mechanism.

The device consists of three components as follows:

1. A top plate
2. A mechanical plate
3. A push plate

The mechanical plate is sandwiched between the top plate and the push plate which retains the cloth in one of two alternative embodiments so that the cloth can be removed after it is dirty and disposed of without a hand having to touch the cloth.

Figure 1:
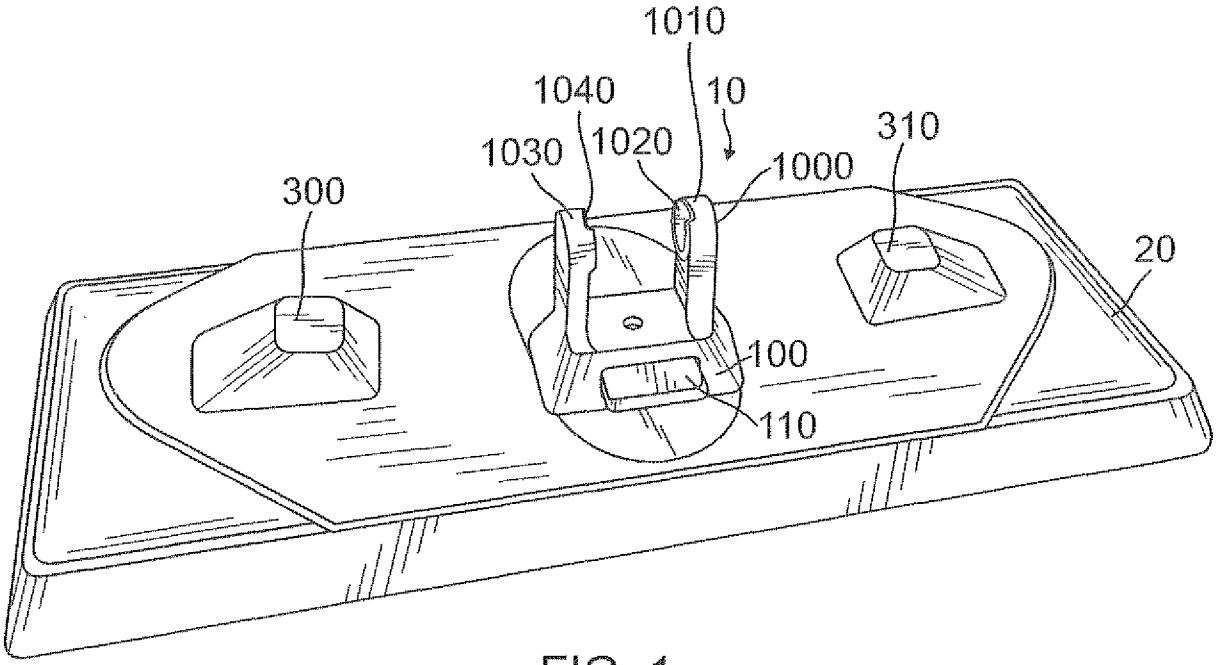
FIG. 1 is a rear top perspective view of the top plate of the present invention, illustrating a yoke in an opened condition.
Figure 2:
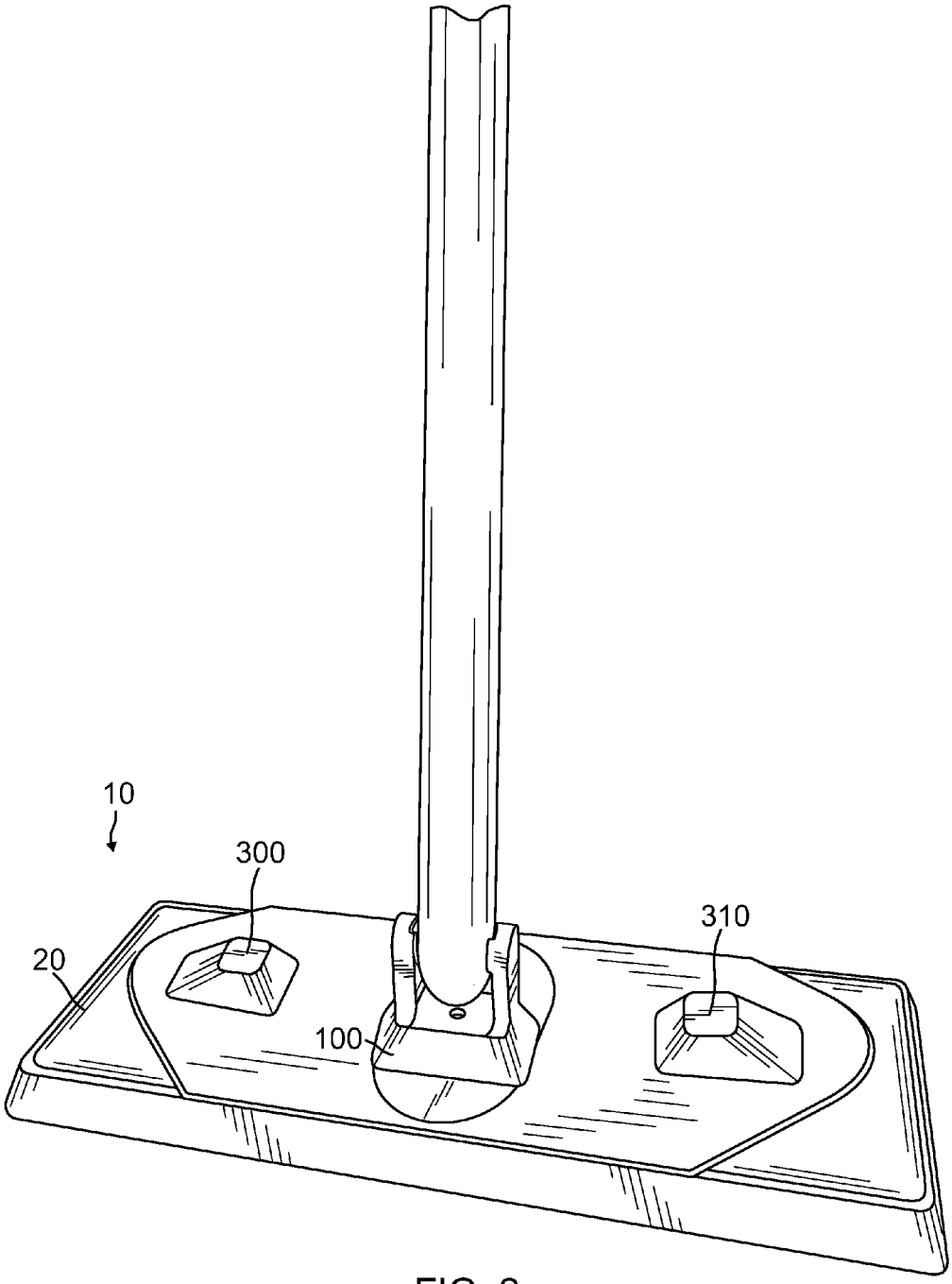
FIG. 2 is a front top perspective view of the top plate of the present invention illustrating the yoke rotatably retaining a handle.

Referring to FIG. 1 there is illustrated a rear top plan view of the top plate 10 illustrating the yoke 1000 in the opened condition and affixed to the housing 100 which retains the trigger mechanism, with the trigger 110 illustrated. The yoke 1000 has a first post 1010 with a U-shaped retaining section 1020 and a second parallel spaced apart post 1030 with a U-shaped retaining section 1040. The U-shaped retaining sections 1020 and 1040 are parallel. Referring to FIG. 2 there is illustrated a front top perspective view of the top plate. The top plate is numbered 10 and has a top surface 20. A handle 1100 is rotatably retained by the U-shaped retaining sections 1020 and 1040 in posts 1010 and 1030 of yoke 1000. The mechanism enables the mop top plate 10 to rotate back and forth as the handle is pushing the mop to scrub a surface, primarily a floor.

Further referring to FIG. 1, beneath the yoke 1000 is the present invention trigger mechanism housing 100 illustrating the trigger 110. The top plate also includes a first cover member 300 and a second cover member 310.

Figure 3:
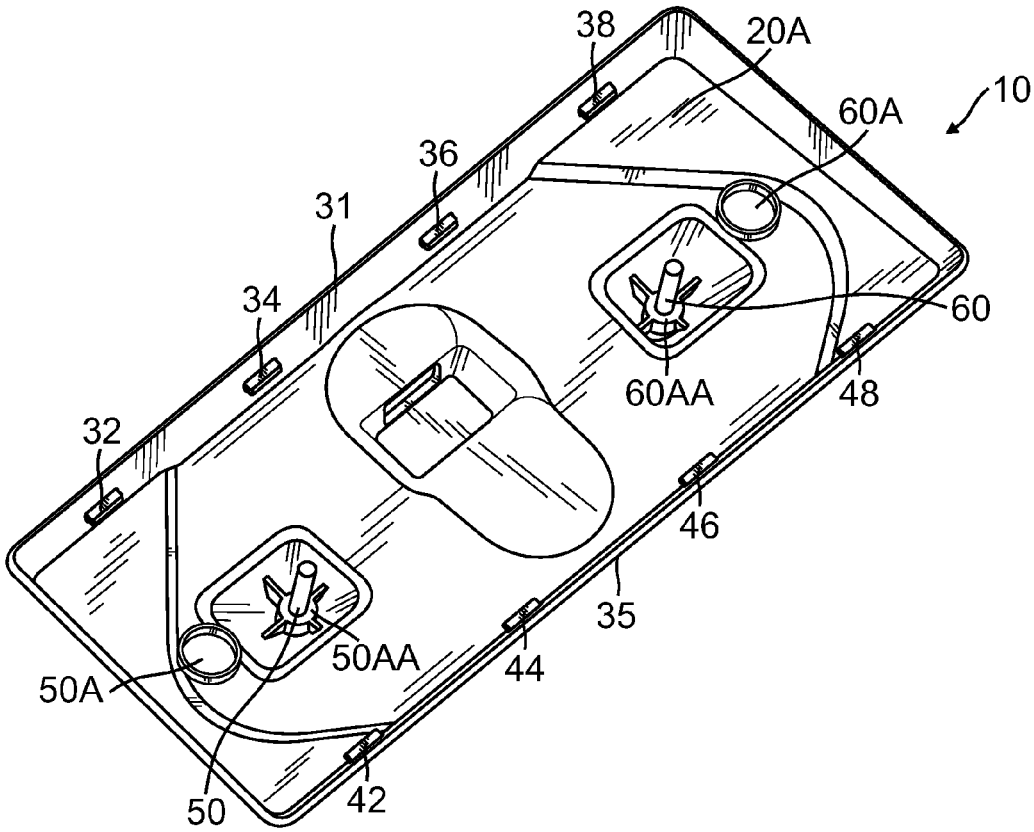
FIG. 3 is a is a bottom perspective view of the top plate.

Referring to FIG. 3, there is illustrated a bottom perspective view of the top plate 10. The bottom 20A of the top plate 10 has male mating members 32, 34, 36 and 38 adjacent a first side 31 and male mating member 42, 44, 46 and 48 adjacent an opposite second side 35 which will mate with female receiving members on the mechanical plate to be discussed subsequently. The bottom 20A of the top plate 10 also has molded into the bottom surface 20A a pair of spaced apart steel pins 50 and 60 which are molded into the bottom surface 20A and serve as up and down guides after assembling the mechanical plate and the springs to the underside or bottom surface 20A of the top plate 10. A TINNERMAN clip (mechanical fastener) located on the push plate (which will be discussed later) is added to each metal pin to secure the push plate from coming off on the downstroke when it is released so that the cleaning cloth which it retains can be discarded.

Figure 4:
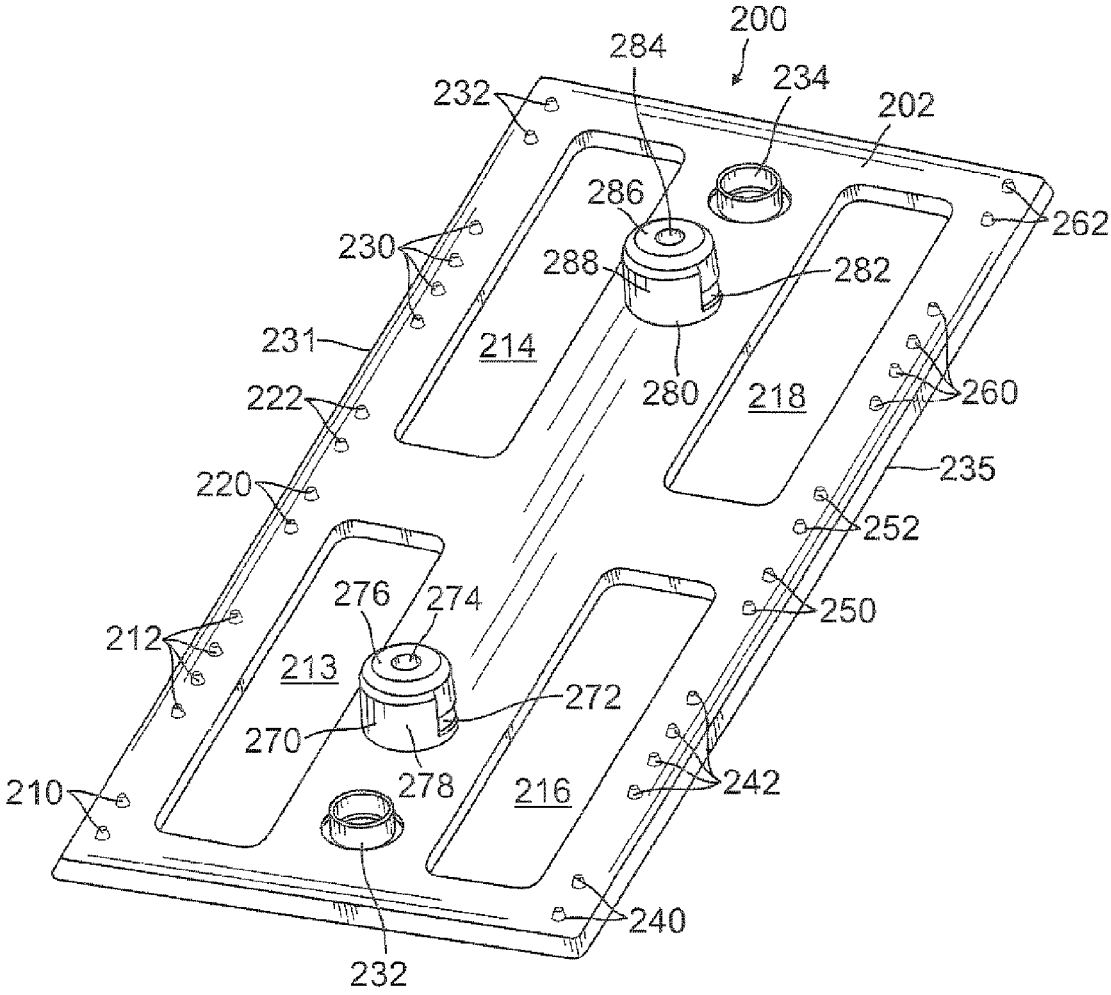
FIG. 4 is a top perspective view of the push plate of the present invention.

Referring to FIG. 4, there is illustrated a top perspective view of the push plate 200. The push plate 200 has a top surface 202 which contains thereon along a first side 231 a multiplicity of groups of spaced apart spikes 210 (two spikes), 212 (four spikes), 220 (two spikes), 222 (two spikes), 230 (four spikes) and 232 (two spikes) and adjacent the opposite side 235 a corresponding multiplicity of groups of spaced apart spikes 240 (two spikes), 242 (four spikes), 250 (two spikes), 252 (two spikes), 260 (four spikes) and 262 (four spikes). The purpose of these spikes is so that a cloth can be wrapped around the push plate 200 and retained in a press fit condition by the spikes 210, 212, 220, 222, 230, and 232 and 240, 242, 250, 252, 260, and 262 as will be later discussed.

Figure 5:
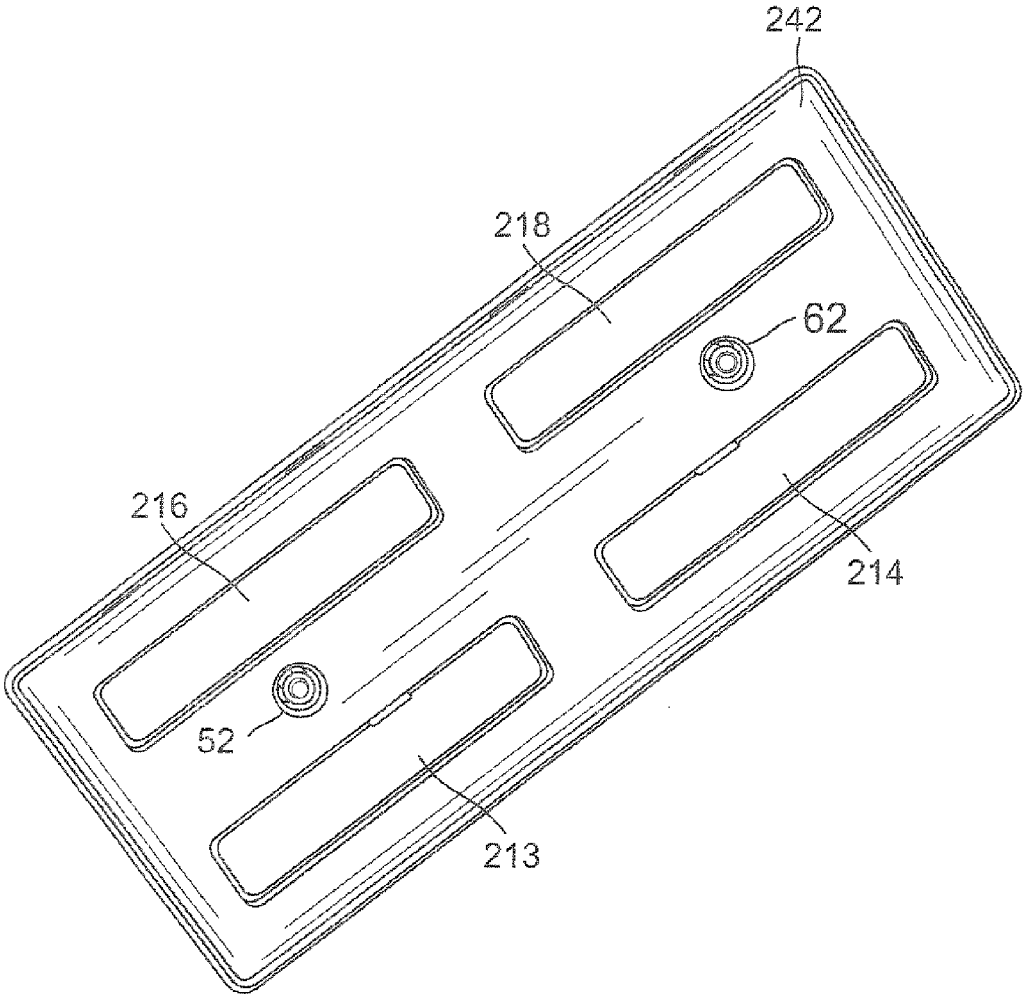
FIG. 5 is a bottom perspective view of the push plate.

The push plate 200 also has flat housing members 213, 214, 216 and 218 on its upper surface 202 and corresponding flat housing members on its bottom surface as illustrated in FIG. 5. Referring to FIG. 5, there is illustrated a bottom perspective view of the push plate 200 having a bottom surface 242 with corresponding locating surfaces 213, 214, 216 and 218. Instead of being held by spikes, the cloth can be wrapped over the push plate 200 so that cloth is aligned with surfaces 213, 214, 216, and 218. These surfaces are aligned with mating hook fasteners from the bottom of the mechanical plate as will be described later. Also illustrated in FIG. 5 are the TINNERMAN clips (mechanical fasteners) 52 and 62 which will be affixed to the bottom of steel pins 50 and 60 of top plate 20 to keep the push plate 200 from falling away when it is released.

Referring again to FIG. 4, on the top surface 202 of the push plate 200 are a pair of ratchet collars 270 and 280 with a respective sidewall 278 and 288 with each respective sidewall having a respective ratchet notch 272 and 282 into which the end of the linkage of the trigger mechanism will be engaged to overcome a spring force as will be described later. Each ratchet collar 270 and 280 has a respective opening 274 and 284 in a respective top 276 and 286. The openings 274 and 284 respectively extend to interior shafts as will be described below within each ratchet collar and extend through the interior shaft of each respective ratchet collar and extend out of the respective ratchet collars 270 and 280 to the bottom surface 242 of the push plate 200 so that the TINNERMAN clips (mechanical fasteners) 52 and 62 can be affixed to the bottom of the steel pins 50 and 60. The top surface 202 and push plate 200 also have a pair of pins or spring housings 232 and 234 to respectively support a respective compression springs.

Referring to FIG. 5, the bottom 242 of the push plate 200 has a pair of metal TINNERMAN CLIPS (mechanical fasteners) 52 and 62 which are respectively press fit onto the steel pins 50 and 60 for the reasons as will be discussed.

Figure 6:
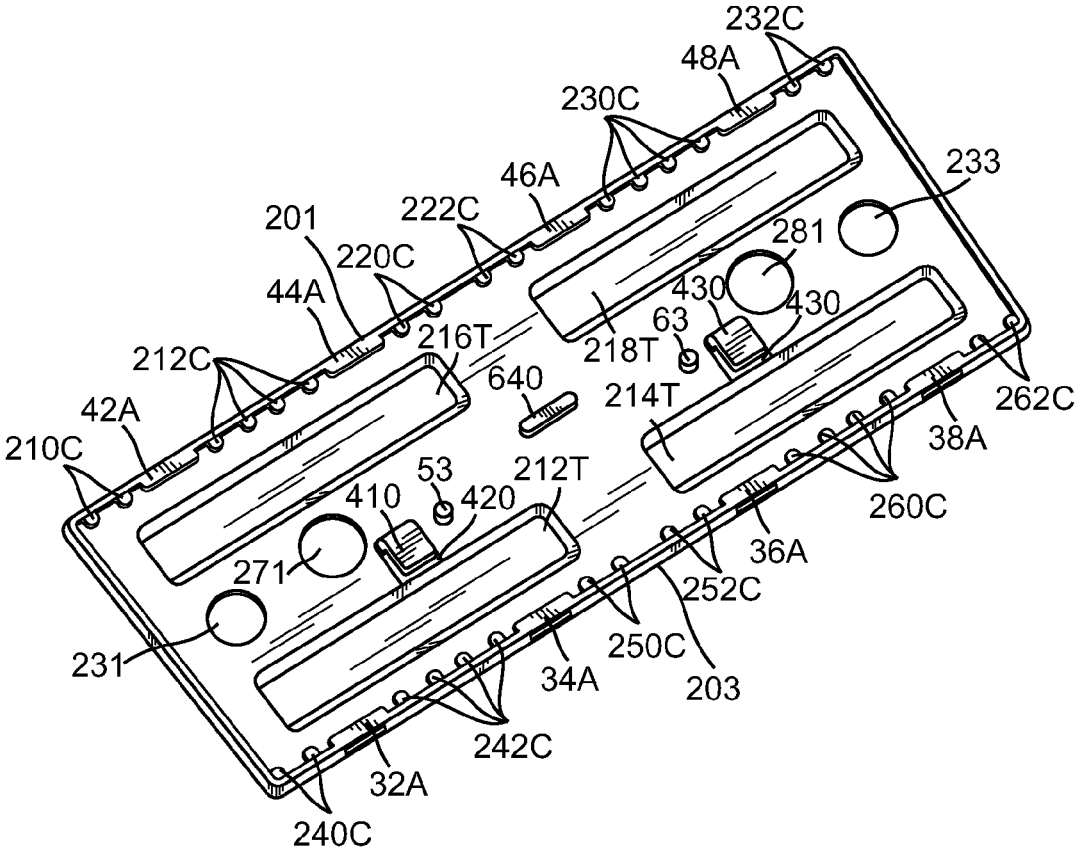
FIG. 6 is a top perspective view of the mechanical plate illustrating the openings to enable members of the push plate to extend therethrough.

The last component of the present invention is the mechanical plate 400. Referring to FIG. 6 there is illustrated the top of the mechanical plate 400 with openings to receive the components of the push plate and additional mechanical plate components as will be described.

Figure 7:
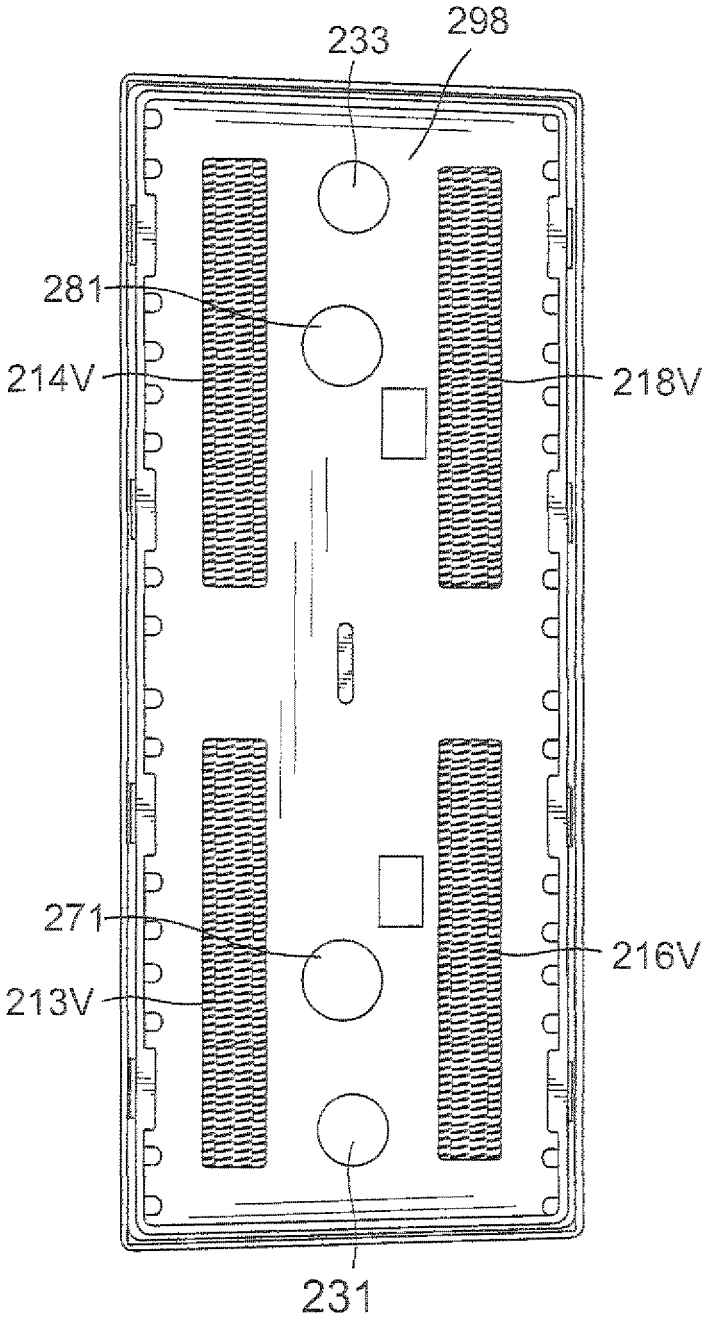
FIG. 7 is a bottom plan view of the mechanical plate illustrating the hook members affixed thereto.

FIG. 6 is a top perspective view of the mechanical plate 400. FIG. 6 discloses female receiving members 32A, 34A, 36A and 38A to respectively receive male mating members 32, 34, 36 and 38 from the bottom of 20A of top plate 10 and female receiving members 42A, 44A, 46A and 48A to respectively receive male mating members 42, 44, 46 and 48 from the bottom 20A of the top plate 10. Opening 231 permits spring housing or retaining post 232 from the push plate 200 to extend therethrough. Opening 271 permits ratchet collar 270 from the push 200 to extend therethrough. Opening 281 permits ratchet collar 280 from the push plate 200 to extend therethrough. Opening 233 permits spring housing or retaining post 232 from the push plate 200 to extend therethrough. The mechanical plate 400 also includes hook member top housings 216T, 218T, 212T and 214T. Referring to FIG. 7, there is illustrated a bottom plan view of the mechanical plate 400. The bottom surface 398 includes hook members 213V, 214V 216V and 218V which are retained underneath respective hook member top housing 213T, 214T, 216T and 216T.

Referring further to FIG. 6, the mechanical plate 400 also has groups of spaced apart spike covers 210C, 212C, 220C, 222C, 230C and 232C adjacent side 201 and groups of spaced apart spike covers 240C, 242C, 250C, 252C 260C and 262C adjacent side 203. When a microfiber cloth 502 is retained by the spikes on the push plate 200, the covers prevent the spikes from penetrating the mechanical plate so that the microfiber cloth 502 is press fit between the spikes and their respective spike covers. When the push plate 200 is against the bottom of the mechanical plate 400, the spikes from the push plate and spikes covers from the mechanical plate are aligned as follows: 210 and 210C; 212 and 212C; 220 and 220C; 222 and 222C; 230 and 230C; 232 and 232C; 240 and 240C; 242 and 242C; 250 and 250C; 252 and 252C; 260 and 262C; and 262 and 262C.

Figure 8:
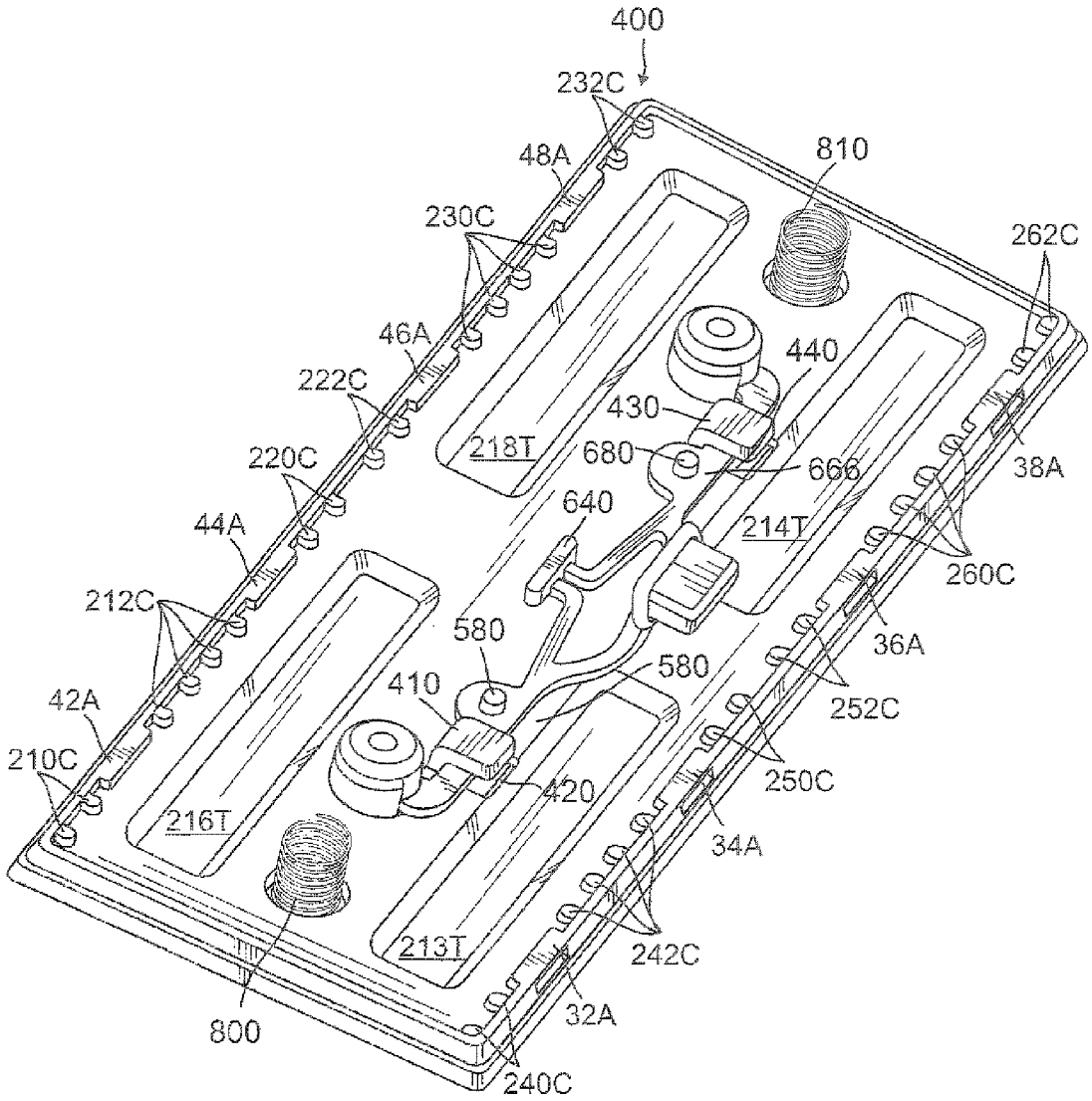
FIG. 8 is a top perspective view of the mechanical plate of the present invention including members of the push plate pushed through the mechanical plate and including the double link single trigger mechanism.
Figure 8A:
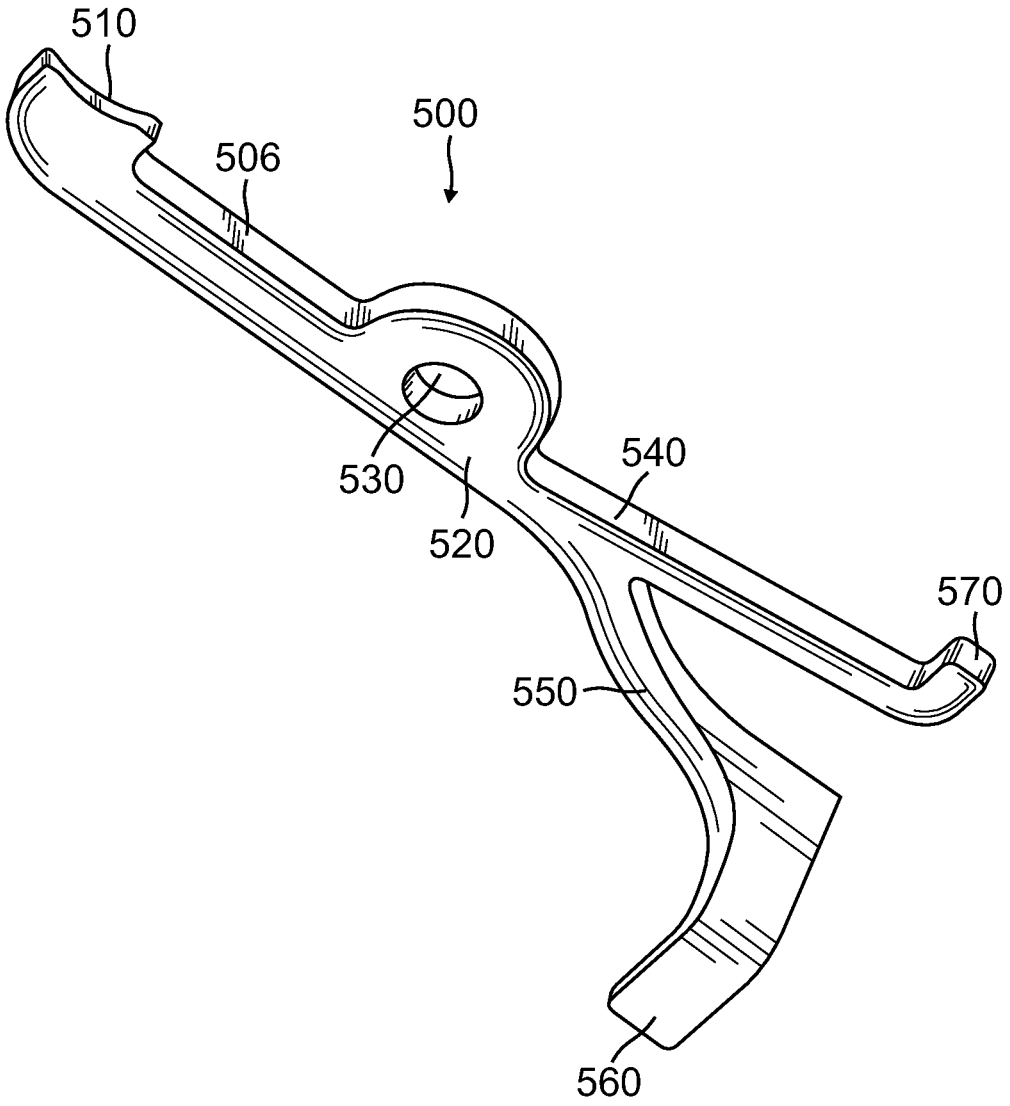
FIG. 8A is a detailed perspective view of the left linkage illustrated in FIG. 8.
Figure 8B:
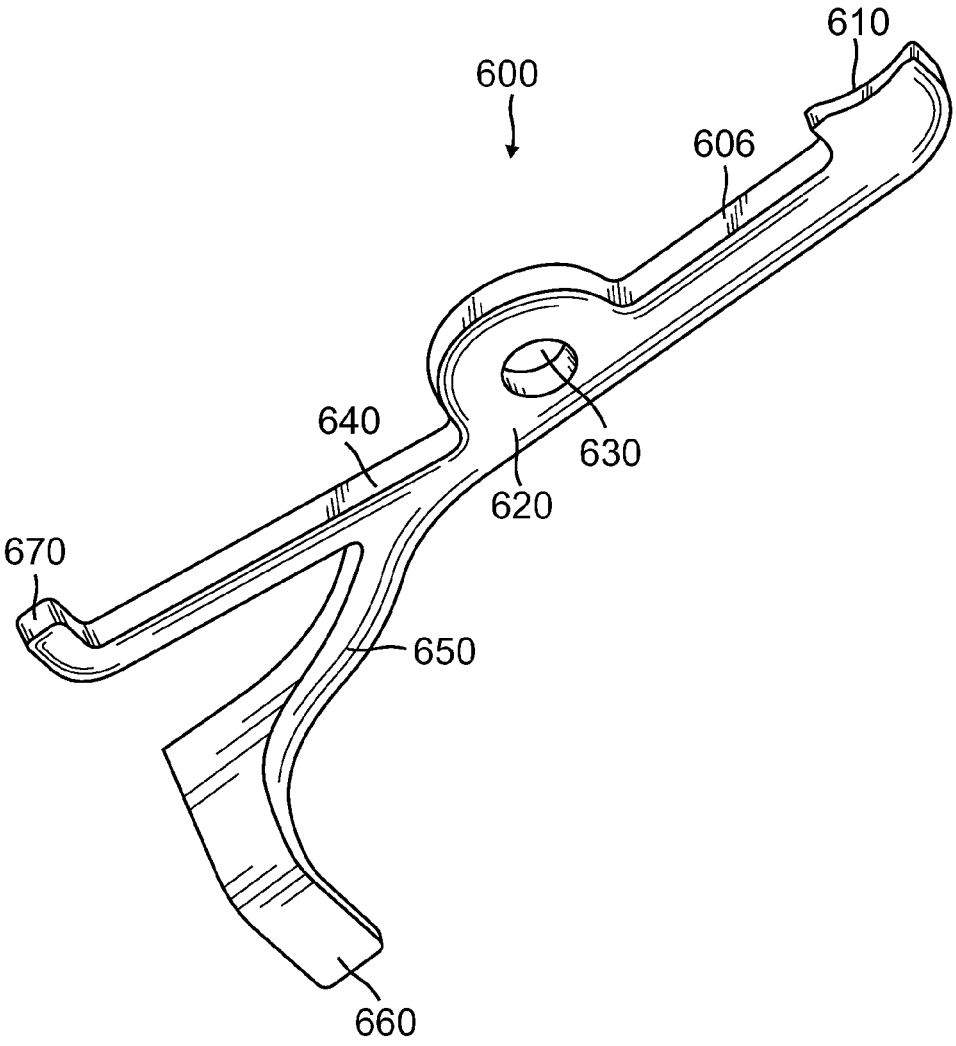
FIG. 8B is a detailed perspective view of the left linkage illustrated in FIG. 8.

FIG. 8 is a top perspective view of the mechanical plate 400 with components from the push plate 200 pushed therethrough as described in FIG. 6 and including additional operating members of the mechanical linkage. Referring first to FIG. 8A, there is a detailed view of the left linkage 500 illustrated in FIG. 8. The linkage 500 at a first end has a tooth mechanism 510 which extends from the first extension arm 506 and ends in the tooth mechanism 510 which will be inserted into a ratchet notch of a respective ratchet collar. The arm 506 then extends to a central pivot section 520 with a central pivot opening 530. The pivot section 520 then extends into a second arm section 540 which extends to a first stop tooth member 570 which will be described later in this description and on the opposite side it has an arcuate extension 550 which extends into a flat tooth member 560 which will be engaged by the trigger mechanism. Referring to FIG. 8B, the right flexible linkage which is numbered 600 in FIG. 6 is the mirror image of the flexible linkage just described. The parts have numbers which correspond to the left linkage but are numbered in the 600 figure numbers. The linkage 600 at a first end has a tooth mechanism 610 which extends from the first extension arm 606 and ends in the tooth mechanism 610 which will be inserted into a ratchet notch of a respective ratchet collar. The arm 606 then extends to a central pivot section 620 with a central pivot opening 630. The pivot section 620 then extends into a second arm section 640 which extends to a first stop tooth member 670 which will be described later in this description and on the opposite side it has an arcuate extension 650 which extends into a flat tooth member 660 which will be engaged by the trigger mechanism.

The opening 530 as described above is inserted in a pivot pin 580 and the corresponding opposite right linkage and opening 630 is inserted in pivot pin 680.

Referring to FIG. 8, on the mechanical plate 400, there is a first stop wall 410 into which linkage arm 506 is inserted. The first stop wall 410 has an opening 420 into which the arm of the first linkage member 506 is inserted and prevented from further transverse movement. The opposite side has a second stop wall 430 with an opening 440 into which the arm 606 of the second linkage member 600 is inserted. The respective end tooth members 570 and 670 of the respective linkages 500 and 600 are retained by a stop member 640 and are therefore restrained from further transverse movement. The opposite end which contains the teeth as discussed above are inserted into a gap in the trigger mechanism 110. The purpose of the stop member 640 is to limit further advance of the flexible linkage and to give the spring effect to keep the linkages 500 and 600 acting as a spring.

Figure 9:
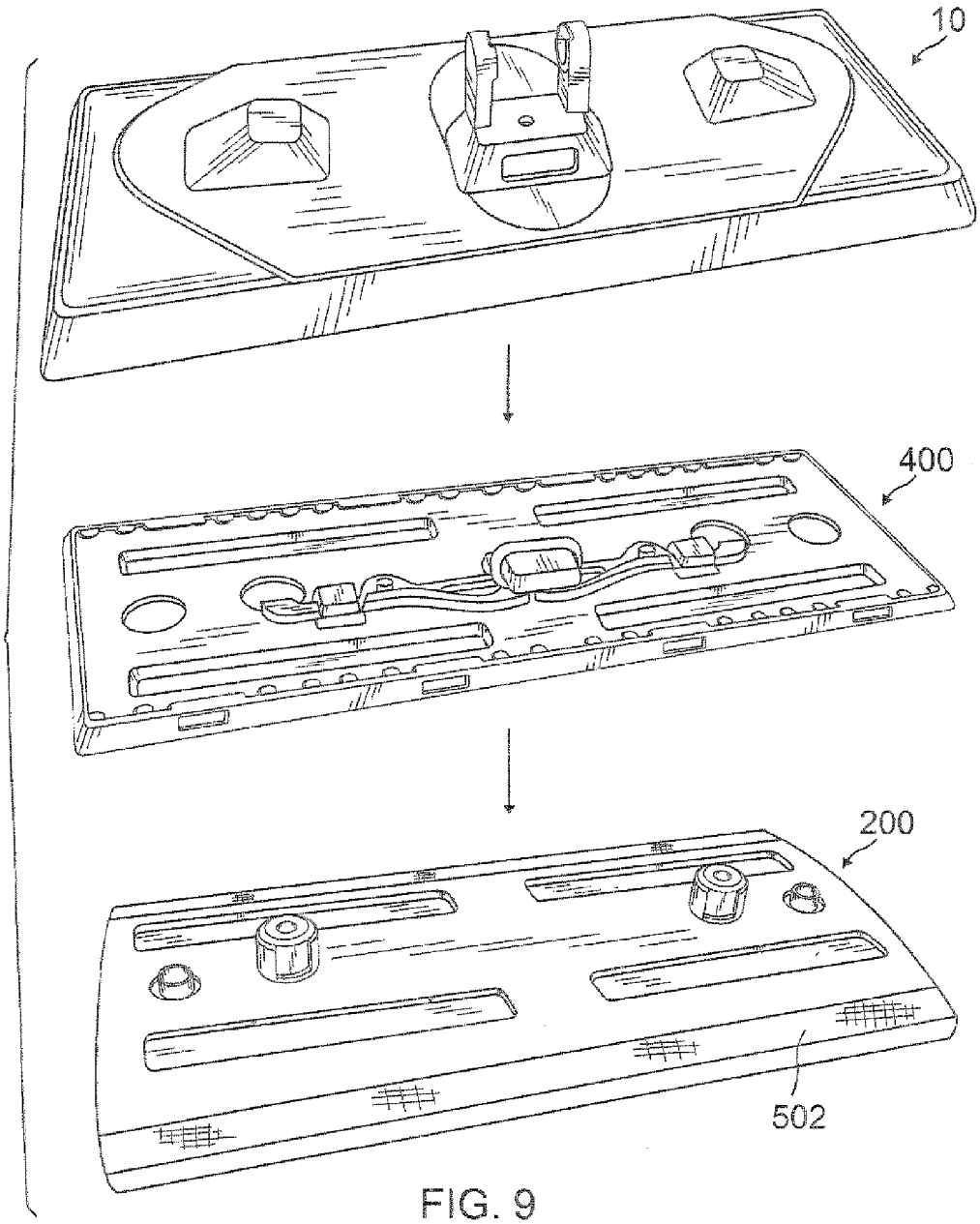
FIG. 9 is an exploded perspective view of the top plate, mechanical plate and push plate with a microfiber cloth beneath the push plate.
Figure 10:
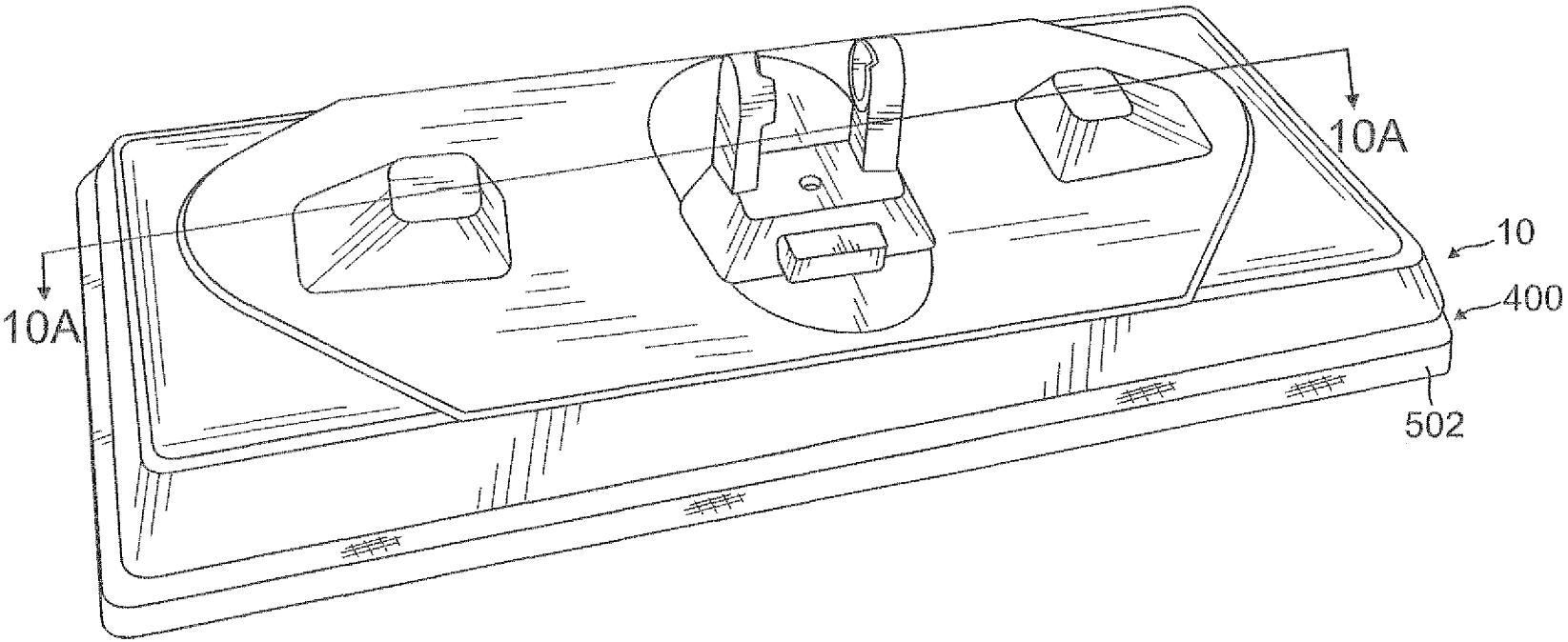
FIG. 10 is a top perspective view of a microfiber cloth in the retained condition retained by the present invention.
Figure 10A:
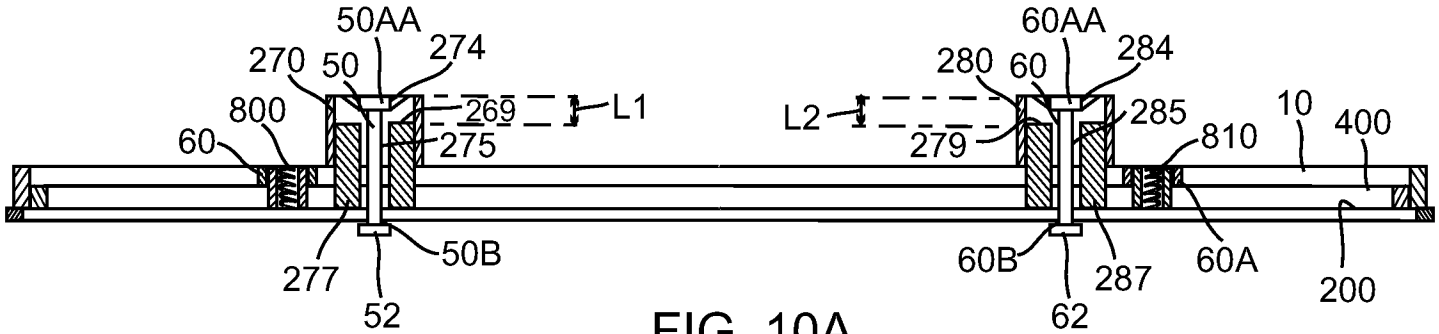
FIG. 10A is a cross-sectional view taken along line 10A-10A of FIG. 10.

FIG. 9 is a top perspective view illustrating the top plate 10, the mechanical plate 400 and the push plate 200 spaced apart. The microfiber cloth 500 is wrapped over the spikes in the push plate 200. FIG. 10 illustrates the top plate 10, mechanical plate 400 and microfiber cover 500 wrapped around the push plate 500 and retained between the spikes on the push plate and the spike covers on the mechanical plate assembled together in the affixed condition retaining a microfiber cloth. FIG. 10A is a cross sectional view illustrating the top plate 10, mechanical plate 400 and push plate 200 in the cloth retained condition where the springs 800 and 810 extend through openings 231 and 233 in the mechanical plate and the ratchet collars 270 and 280 extends through respective openings 271 and 281 in the mechanical plate so that they appear as shown in FIG. 8. The top plate is assembled onto the assembly so that the pins 50 and 60 extend through openings 274 and 284 in ratchet collars 270 and 280 and extend through shafts 275 and 285 for the pin movable lengths "L1" and L2" of the respective ratchet collars 270 and 280 and extend out of the bottom 277 and 287 of ratchet collars 270 and 280 so that the bottom 50B and 60B of steel pins 50 and 60 are retained by the Tinnerman pins 52 and 62 illustrated in FIG. 10A on the bottom of the push plate. Therefore, the push plate 200 is retained in this way onto the top plate 10 with the mechanical plate 400 sandwiched between them.

Figure 11:
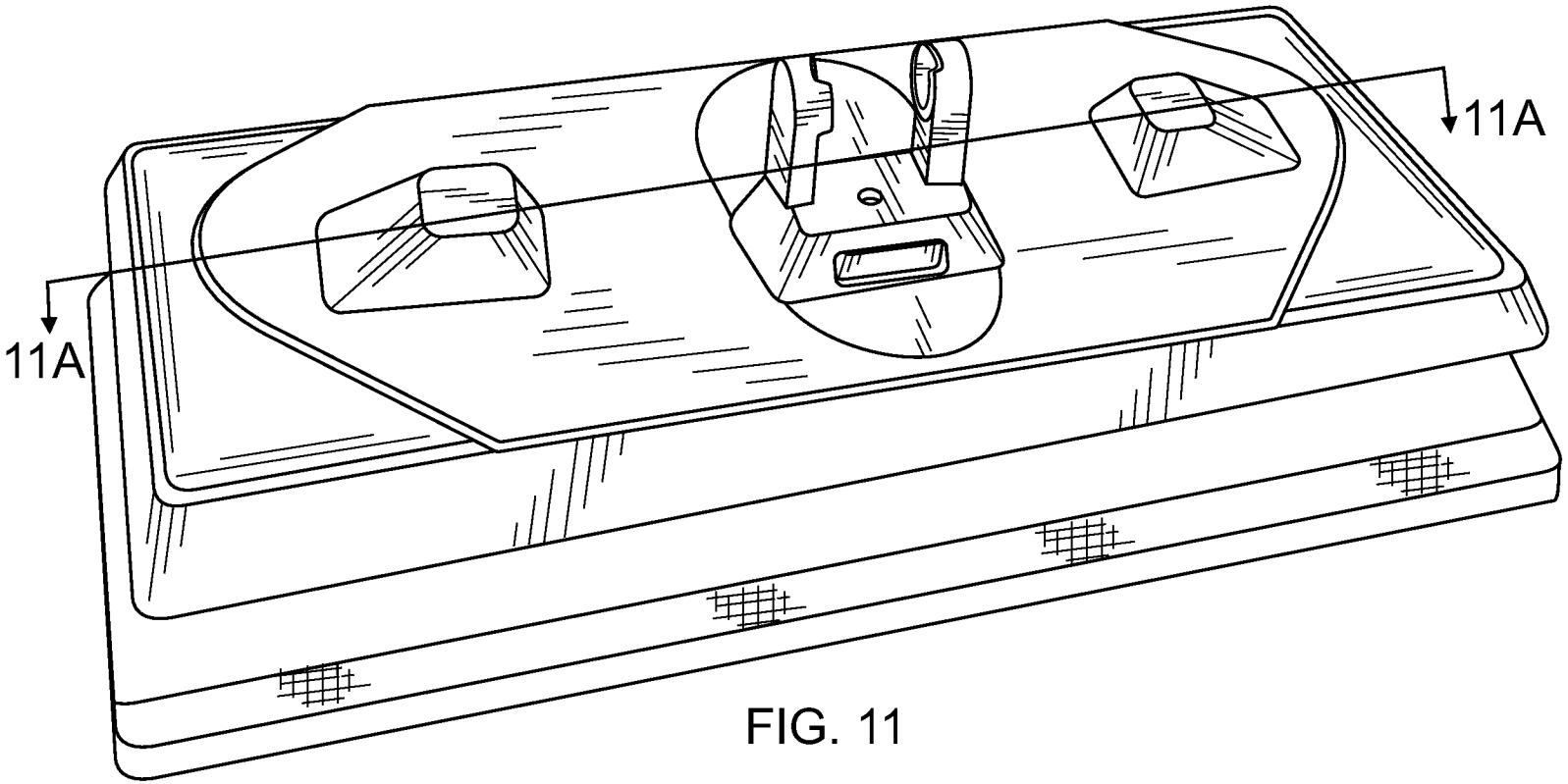
FIG. 11 is a top perspective view of a microfiber cloth in the released condition from the present invention.
Figure 11A:
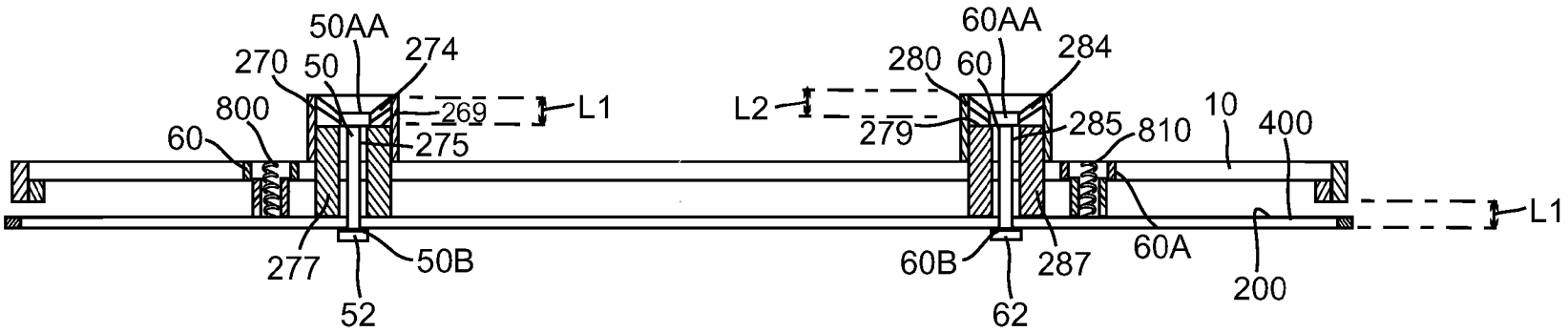
FIG. 11A is a cross-sectional view taken along line 11A-11A of FIG. 11.

Springs 800 and 810 are retained on the retaining posts 60 and 60A from the bottom 8A of the top plate 10. The assembly is held together because the respective tooth 510 of flexible linkage 500 is inserted into notch 272 of notch collar 270 and corresponding tooth 610 of flexible linkage 600 is inserted into notch 282 of notch collar 280 and by this attachment overcomes a downward spring force from springs 800 and 810. When the trigger 110 is pushed inwardly, the flexible linkages rotate about pivot pin 580 and 680 so that the teeth 510 and 610 become disengaged from the notches 272 and 282 and the downward spring force of force springs 800 and 810 cause push plate 200 to move away from the bottom of the mechanical plate 400 by the distance that the steel pins 50 and 60 are in their respective collars 270 and 280 until the respective widened heads 50AA and 60AA hits the respective tops of interior walls 269 an 279 within ratchet collars 270 and 280. Immediately before, a microfiber cloth 500 is held between the spikes on the push plate and spike covers on the mechanical plate as previously discussed. When the trigger is activated as just discussed, the push plate 200 moves away from the mechanical plate 400 by the distances L1 and L2 so the microfiber cloth is released so it can be discarded. This is illustrated in the perspective view of FIG. 11 and the cross sectional view of FIG. 11A.

Figure 12:
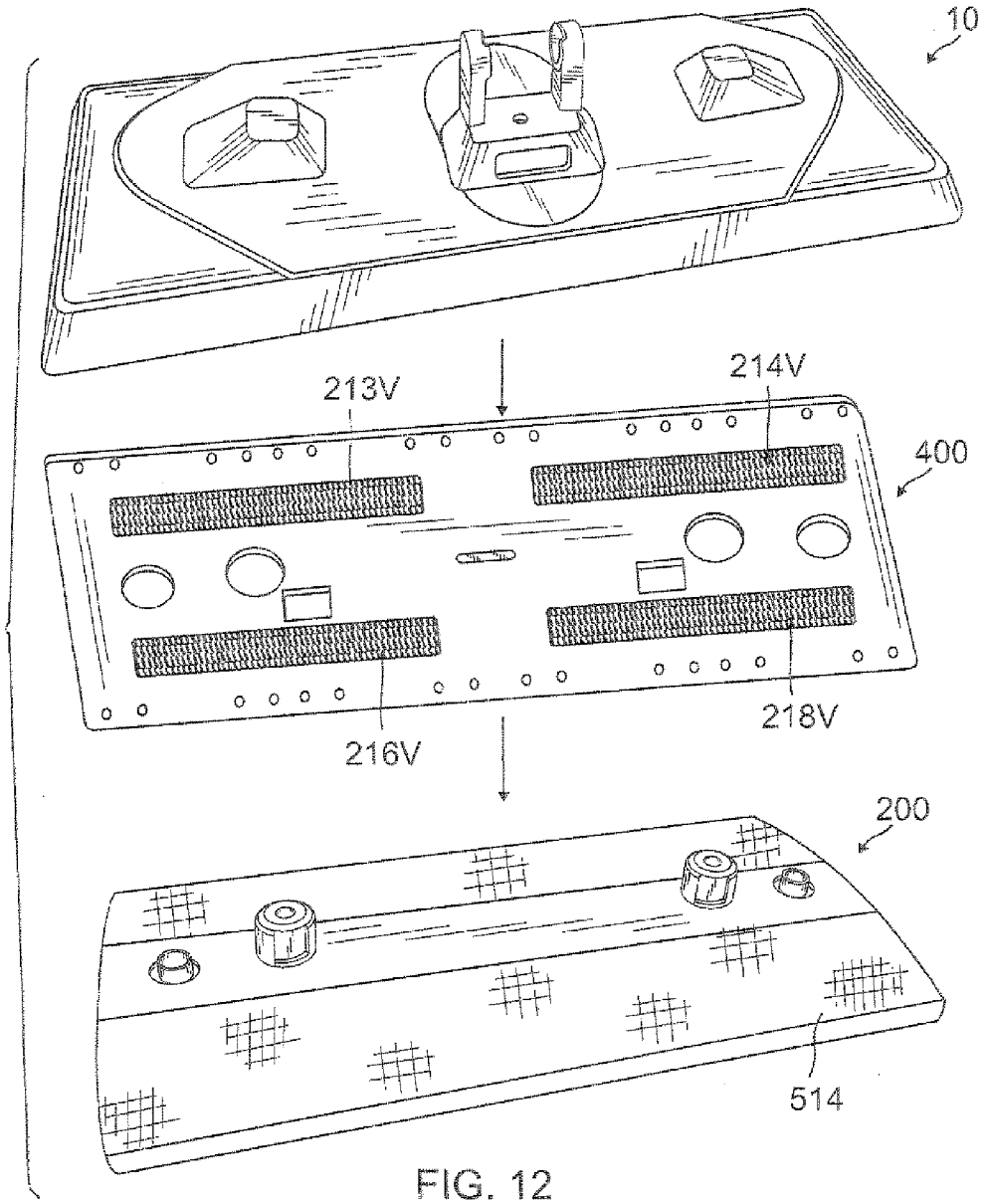
FIG. 12 is an exploded perspective view of the top plate, mechanical plate and push plate with a non-woven cloth partially wrapped around the push plate.

FIGS. 12, 13, 13A, 14 and 14A illustrated a corresponding embodiment where a non-woven cloth is retained. FIG. 12 is a top perspective view illustrating the top plate 10, the mechanical plate 400 and the push plate 200 spaced apart. The non-woven cloth 510 is wrapped over the push plate 200 so that the non-woven cloth 510 can be retained by the hook members 212V, 214V, 216V and 218V on the bottom of the mechanical plate 400.

Figure 13:
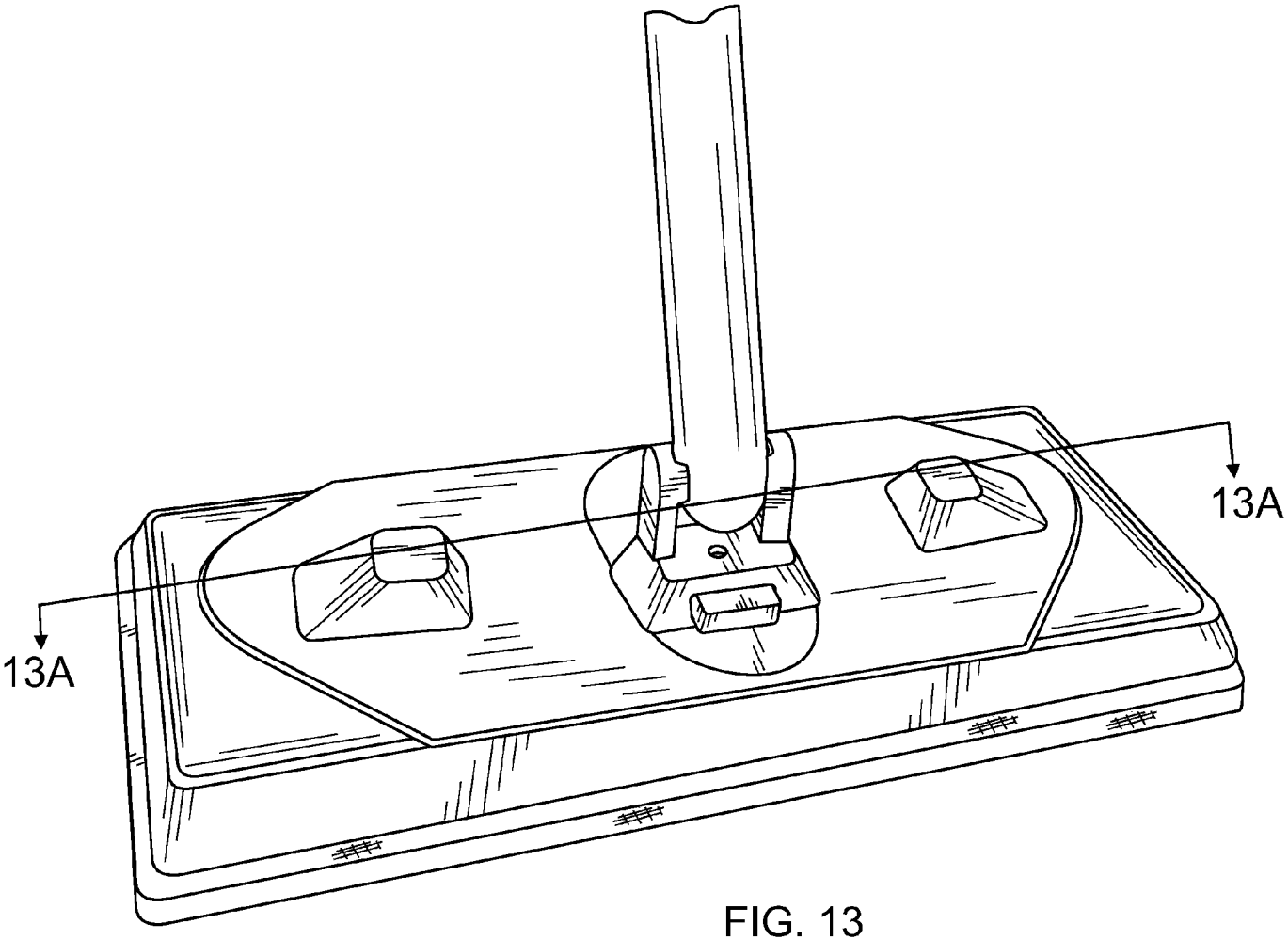
FIG. 13 is a top perspective view of a non-woven cloth in the retained condition retained by the present invention.
Figure 13A:
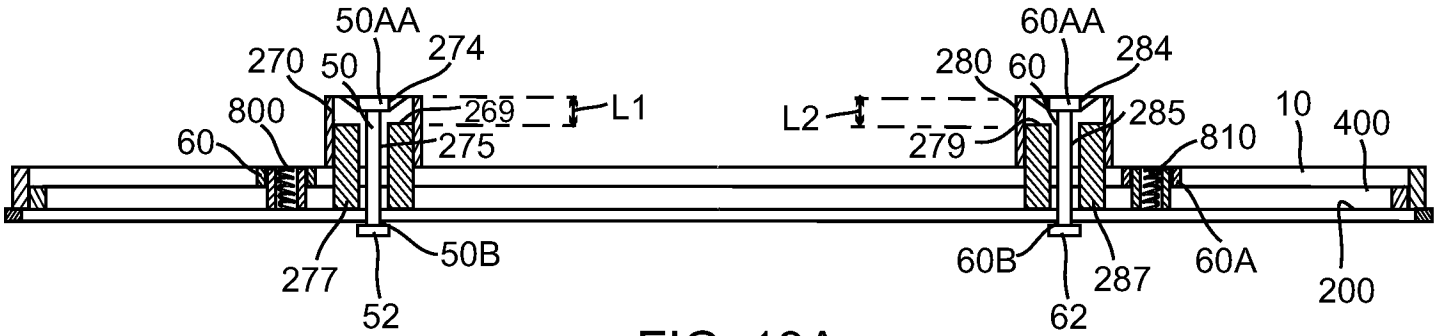
FIG. 13A is a cross-sectional view taken along line 13A-13A of FIG. 13.
Figure 14:
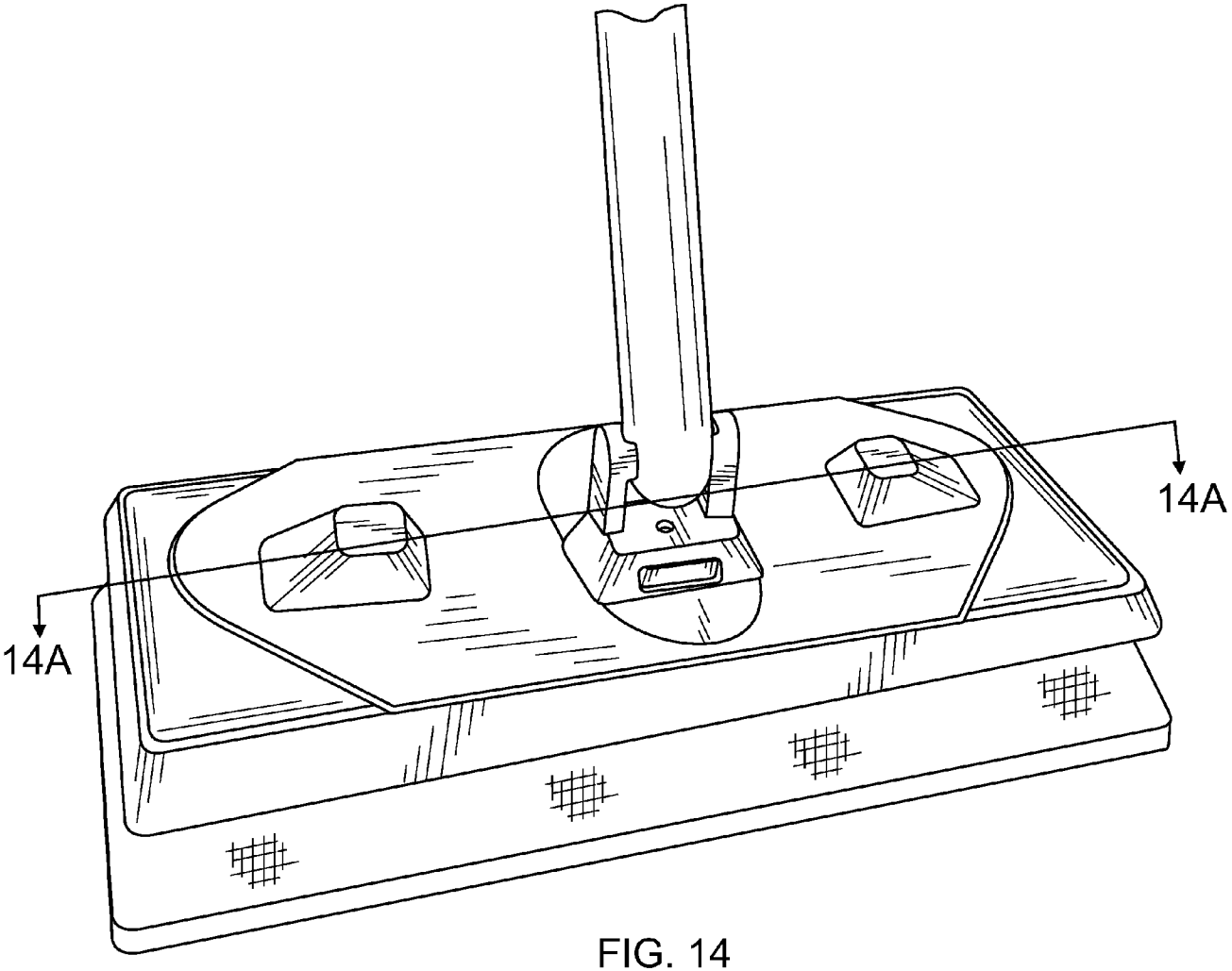
FIG. 14 is a top perspective view of a non-woven cloth in the released condition from the present invention.
Figure 14A:
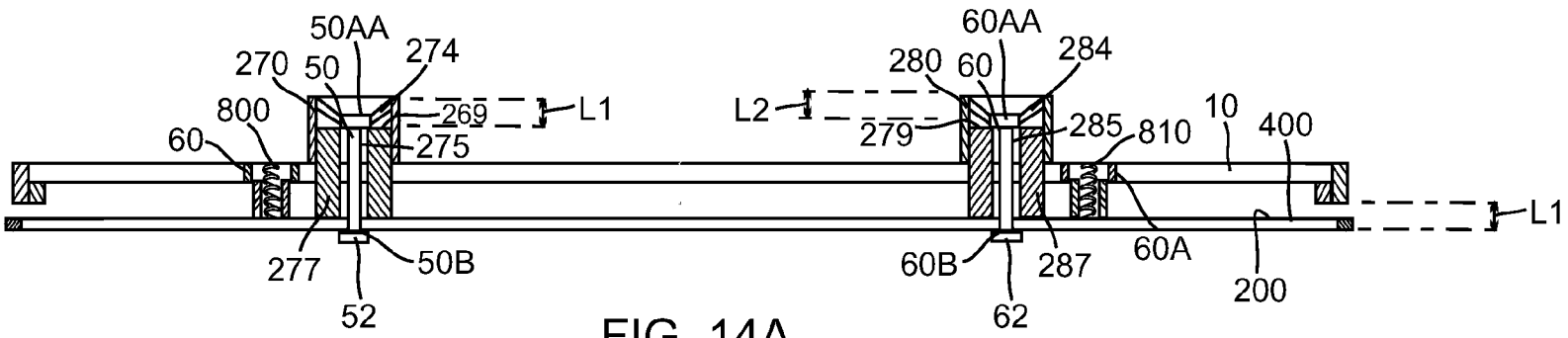
FIG. 14A is a cross-sectional view taken along line 14A-14A of FIG. 14.

FIG. 13 illustrates the top plate 10, mechanical plate 400 and non-woven cloth 510 wrapped around the push plate 500 and retained by the hook members 212V, 214V, 216V and 218V on the mechanical plate assembled together in the affixed condition retaining a non-woven cloth. FIG. 13A is a cross sectional view illustrating the top plate 10, mechanical plate 400 and push plate 200 in the non-woven cloth in the retained condition where the springs 800 and 810 extend through openings 231 and 233 in the mechanical plate and the ratchet collars 270 and 280 extends through respective openings 271 and 281 in the mechanical plate so that they appear as shown in FIG. 8. The top plate is assembled onto the assembly so that the pins 50 and 60 extend through openings 274 and 284 in ratchet collars 270 and 280 and extend through shafts 275 and 285 for the movable lengths "L1" and L2" of the respective ratchet collars 270 and 280 and extend out of the bottom 277 and 287 of ratchet collars 270 and 280 so that the bottom 50B and 60B of steel pins 50 and 60 are retained by the Tinnerman pins 52 and 62 illustrated in FIG. 10A on the bottom of the push plate. Therefore, the push plate 200 is retained in this way onto the top plate 10 with the mechanical plate 400 sandwiched between them.

As illustrated in FIG. 8, the left linkage 500 has its tooth 510 inserted into notch 272 of notch collar 270 and the tooth 610 of right linkage 600 is inserted into notch 282 of notch collar 280. There is also a first compression spring 800 and a second compression spring 810 which respectively rest around on spring housing or supporting posts 232 and 234 which are illustrated in FIG. 4. The springs are retained in the underside of the top plate 20A by post members 60 and 60A so that each respective spring 800 and 810 is retained in the bottom of the stationary top plate as best illustrated in FIG. 3A. As best illustrated in the top plan view of FIG. 4, ratchet collar 270 has a top opening 274 on its top 276 and ratchet collar 280 has a top opening 284 on its top 286. Therefore, when respective posts 50 and 60 are inserted into the openings 274 and 284 of ratchet collars 270 and 280, they extend to the bottom of the collar and are retained by the TINNERMAN clips (mechanical fasteners) illustrated in FIG. 5 numbers 52 and 62. Therefore, the travel distance that the push plate 200 can make is the length of the pins 50 and 60 within collars 270 and 280. When assembled, the top plate 10 is inserted into the mechanical plate 400 by having the respective pins or posts 50 and 60 respectively inserted into notch collar openings 274 and 284 of respective notch collars 270 and 280 and then the push plate 200 is affixed by having the respective spring collars affixed to the bottom of the top plate as previously discussed and having the TINNERMAN clips (mechanical fasteners) 52 and 62 respectively affixed onto the ends of pins 50 and 60 to affix the push plate 200 to the bottom of the top plate 10 with the mechanical plate 400 between the top plate 10 and push plate 200.

FIG. 9 is a top perspective view illustrating the top plate 10, the mechanical plate 400 and the push plate 200 spaced apart. The microfiber cloth 502 is wrapped over the spikes in the push plate 200. FIG. 10 illustrates the top plate 10, mechanical plate 400 and microfiber cloth 502 wrapped around the push plate 200 and retained between the spikes on the push plate and the spike covers on the mechanical plate assembled together in the affixed condition retaining a microfiber cloth 502. FIG. 10A is a cross sectional view illustrating the top plate 10, mechanical plate 400 and push plate 200 in the cloth retained condition where the springs 800 and 810 extend through openings 231 and 233 in the mechanical plate and the ratchet collars 270 and 280 extend through respective openings 271 and 281 in the mechanical plate so that they appear as shown in FIG. 8. The top plate is assembled onto the assembly so that the pins 50 and 60 extend through openings 274 and 284 in ratchet collars 270 and 280 and extend through shafts 275 and 285 for the pin movable lengths "L1" and "L2" of the respective ratchet collars 270 and 280 and extend out of the bottom 277 and 287 of ratchet collars 270 and 280 so that the bottom 50B and 60B of steel pins 50 and 60 are retained by the TINNERMAN CLIPS (mechanical fasteners) 52 and 62 illustrated in FIG. 10A on the bottom of the push plate. Therefore, the push plate 200 is retained in this way onto the top plate 10 with the mechanical plate 400 sandwiched between them.

Springs 800 and 810 are retained on the retaining posts 60 and 60A from the bottom 8A of the top plate 10. The assembly is held together because the respective tooth 510 of flexible linkage 500 is inserted into notch 272 of notch collar 270 and corresponding tooth 610 of flexible linkage 600 is inserted into notch 282 of notch collar 280 and by this attachment overcomes a downward spring force from springs 800 and 810. When the trigger 110 is pushed inwardly, the flexible linkages rotate about pivot pin 580 and 680 so that the teeth 510 and 610 become disengaged from the notches 272 and 282 and the downward spring force of force springs 800 and 810 cause push plate 200 to move away from the bottom of the mechanical plate 400 by the distance that the steel pins 50 and 60 are in their respective collars 270 and 280 until the respective widened heads 50AA and 60AA hits hit the respective tops of interior walls 269 and 279 within ratchet collars 270 and 280. Immediately before, a microfiber cloth 502 is held between the spikes on the push plate and spike covers on the mechanical plate as previously discussed. When the trigger is activated as just discussed, the push plate 200 moves away from the mechanical plate 400 by the distances L1 and L2 so the microfiber cloth 502 is released so it can be discarded. This is illustrated in the perspective view of FIG. 11 and the cross sectional view of FIG. 11A.

FIGS. 12, 13, 13A, 14 and 14A illustrate a corresponding embodiment where a non-woven cloth is retained. FIG. 12 is a top perspective view illustrating the top plate 10, the mechanical plate 400 and the push plate 200 spaced apart. The non-woven cloth 514 is wrapped over the push plate 200 so that the non-woven cloth 514 can be retained by the hook members 213V, 214V, 216V and 218V on the bottom of the mechanical plate 400.

FIG. 13 illustrates the top plate 10, mechanical plate 400 and non-woven cloth 510 wrapped around the push plate 200 and retained by the hook members 213V, 214V, 216V and 218V on the mechanical plate assembled together in the affixed condition retaining a non-woven cloth. FIG. 13A is a cross sectional view illustrating the top plate 10, mechanical plate 400 and push plate 200 in the non-woven cloth in the retained condition where the springs 800 and 810 extend through openings 231 and 233 in the mechanical plate and the ratchet collars 270 and 280 extend through respective openings 271 and 281 in the mechanical plate so that they appear as shown in FIG. 8. The top plate is assembled onto the assembly so that the pins 50 and 60 extend through openings 274 and 284 in ratchet collars 270 and 280 and extend through shafts 275 and 285 for the movable lengths "L1" and L2" of the respective ratchet collars 270 and 280 and extend out of the bottom 277 and 287 of ratchet collars 270 and 280 so that the bottom 50B and 60B of steel pins 50 and 60 are retained by the TINNERMAN clips (mechanical fasteners) 52 and 62 illustrated in FIG. 10A 4 on the bottom of the push plate. Therefore, the push plate 200 is retained in this way onto the top plate 10 with the mechanical plate 400 sandwiched between them.

Springs 800 and 810 are retained on the retaining posts 60 and 60A from the bottom 8A of the top plate 10. The assembly is held together because the respective tooth 510 of flexible linkage 500 is inserted into notch 272 of notch collar 270 and corresponding tooth 610 of flexible linkage 600 is inserted into notch 282 of notch collar 280 and by this attachment overcomes a downward spring force from springs 800 and 810. When the trigger 110 is pushed inwardly, the flexible linkages rotate about pivot pin 580 and 680 so that the teeth 510 and 610 become disengaged from the notches 272 and 282 and the downward spring force of force springs 800 and 810 cause push plate 200 to move away from the bottom of the mechanical plate 400 by the distance that the steel pins 50 and 60 are in their respective collars 270 and 280. At that point, a non-woven cloth 510 is held by the hooks between the mechanical plate and push plate as previously discussed. When the trigger is activated as just discussed, the push plate 200 moves away from the mechanical plate 400 by the distances L1 and L2 until the widened pin tops hit the respective tops of the interior ratchet walls 269 and 279 so that the non-woven cloth is pulled away from the hooks 213V, 214V,

216V and 218V and is released so it can be discarded. This is illustrated in the perspective view of FIG. 14 and the cross sectional view of FIG. 14A.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A flat mop having a handle and apparatus for retaining the handle to a top plate of the flat mop, the flat mop comprising:

a. a top plate including a first cover member and a second cover member, a bottom surface further retaining a pair of spaced apart steel pins which are molded into the bottom surface respectively aligned with the first cover and the second cover;

b. a push plate having a top surface which contains thereon along a first side a multiplicity of groups of spaced apart spikes and adjacent an opposite side of the push plate a corresponding multiplicity of groups of spaced apart spikes, the push plate also has four spaced apart flat housing members on the top surface of the push plate and four corresponding flat housing members on the bottom of the push plate, a pair of spaced apart TINNERMAN clips (mechanical fasteners) affixed to the bottom surface of the push plate and extending to the top surface and respectively aligned with a respective steel pin, the top surface of the push plate retaining a spaced apart pair of ratchet collars with a respective sidewall with each respective sidewall having a respective ratchet notch into which an end tooth of a linkage of a trigger mechanism will be engaged, each ratchet collar has a respective opening in a respective top, each opening respectively extending to interior shafts within each ratchet collar and extend through the interior shaft of each respective ratchet collar and extend out of the respective ratchet collar to a bottom surface of the push plate so that a respective one of the TINNERMAN clips (mechanical fasteners) can be affixed to a respective bottom of one of the steel pins, the top of the push plate also has a pair of spring housings to respectively support a respective compression springs;

c. a mechanical plate with openings to receive the pair of ratchet collars and a pair of spring housings which extend through the mechanical plate from the push plate;

d. the mechanical plate having a left ratchet collar and a right ratchet collar and first and second spring housings from the push plate pushed through respective openings in the mechanical plate which also includes additional operating mechanical linkages including a left linkage having a first end which extends from a first extension arm and ends in a left tooth mechanism which is inserted into a first ratchet notch of a first ratchet collar, the arm then extends to a central pivot section with a central pivot opening which is inserted onto a left pivot pin, the pivot section then extends into a second left arm section which extends to a first stop tooth member on the second left arm section and on the opposite side of the second left arm section, has an arcuate extension which extends into a flat tooth member which is engaged by a trigger mechanism, a right flexible linkage which is a mirror image of the left flexible linkage, the right flexible linkage at a first end having a tooth mechanism which extends from a first right extension arm and ends in the tooth mechanism inserted into a ratchet notch of the right ratchet collar, the right extension arm then extends to a central pivot section with a central pivot opening which is inserted onto a right pivot pin, the pivot section then extends into a second right arm section which extends to a first stop tooth member of the second right arm section and on the opposite side of the second right arm section has an arcuate extension which extends into a flat tooth member which is engaged by the trigger mechanism, the mechanical plate further including a left stop wall having a opening into which the arm of the left linkage member is inserted and prevented from further transverse movement, and a second stop wall with an opening into which the arm of the right linkage member is inserted, the respective end tooth members of the respective linkages are retained by a stop member and are therefore restrained from further transverse movement, each opposite end which contains a respective tooth are respectively inserted into a gap in the trigger mechanism, the stop member serves to limit further advance of each flexible linkage and to give a spring effect to keep the linkages acting as a spring, the tooth of the left linkage is inserted into a notch of the left notch collar and a tooth of right linkage is inserted into a notch of the right notch collar, there is also a first compression spring and a second compression spring which respectively rest around a first and a second spring housing support posts, each compression spring is respectively retained in an underside of the top plate by respective post members and each respective spring is retained in the bottom of the stationary top plate, each ratchet collar respectively has a top opening on a respective top surface of each respective ratchet collar, so that when respective pins from the underside of the top plate are inserted into the openings of the left and right ratchet collar, the respective pins from the underside of the top plate respectively extend to the bottom of the collar and are retained by the TINNERMAN clips (mechanical fasteners) so that a travel distance that the push plate can make is a length of the distance from a respective widened top part of a pin to a top of an interior wall of a respective ratchet collar; and e. when assembled, the top plate is inserted into the mechanical plate by having the respective pins respectively inserted into respective notch collar openings of each respective notch collars and then the push plate is affixed by having each one of the respective spring collars affixed to the bottom of the top plate and having the TINNERMAN clips (mechanical fasteners) respectively affixed onto a respective end of a respective one of the pins to affix the push plate to the bottom of the top plate with the mechanical plate between the top plate and push plate with a micro-fiber cloth wrapped around the push plate and press fit retained by the spikes between the push plate and the mechanical plate and when the trigger is activated, a downward force of the springs cause the push plate to move away from the mechanical plate and the micro-fiber cloth is released from the spikes and is released.

2. A flat mop having a handle and apparatus for retaining the handle to a top plate of the flat mop, the flat mop comprising:

a. a top plate including a first cover member and a second cover member, a bottom surface further retaining a pair of spaced apart steel pins which are molded into the bottom surface respectively aligned with the first cover and the second cover, b. a push plate having four spaced apart flat housing members on the upper surface of the push plate and four corresponding flat housing members on the bottom surface of the push plate, a pair of spaced apart TINNERMAN clips (mechanical fasteners) affixed to the bottom surface of the push plate and extending to the top surface of the push plate and respectively aligned with a respective steel pin, the top surface of the push plate retaining a spaced apart pair of ratchet collars with a respective sidewall with each respective sidewall having a respective ratchet notch into which an end tooth of a linkage of a trigger mechanism will be engaged, each ratchet collar has a respective opening in a respective top, each opening respectively extending to interior shafts within each ratchet collar and extend through the interior shaft of each respective ratchet collar and extend out of a respective one of the pair of the respective ratchet collars to a bottom surface of the push plate so that the TINNERMAN clips (mechanical fasteners) can be affixed to a respective bottom of one of the steel pins, the top surface of the push plate also has a pair of spring housings to respectively support a respective compression springs;

c. a mechanical plate with openings to receive the pair of ratchet collars and a pair of spring housings which extend through the mechanical plate from the push plate, the mechanical plate also includes four spaced apart hook member top housings corresponding to hook retaining members on a bottom surface of the mechanical plate which respectively retain hook members which are retained underneath respective hook member top housings, the mechanical plate also has groups of spaced apart spike covers which correspond to spaced apart group of spikes on the push plate so that the spike covers prevent the spikes from penetrating the mechanical plate when the push plate is against the bottom of the mechanical plate, the spikes from the push plate and spikes covers from the mechanical plate are aligned;

d. the mechanical plate having a left ratchet collar and a right ratchet collar and first and second spring housings from the push plate pushed through respective openings in the mechanical plate which also includes additional operating mechanical linkages including a left flexible linkage having a first end which extends from a first extension arm and ends in a left tooth mechanism which is inserted into a first ratchet notch of a first ratchet collar, the arm then extends to a central pivot section with a central pivot opening which is inserted onto a left pivot pin, the pivot section then extends into a second left arm section which extends to a first stop tooth member on the second left arm section and on an opposite side of the second left arm section has an arcuate extension which extends into a flat tooth member which is engaged by a trigger mechanism, a right flexible linkage which is a mirror image of the left flexible linkage, the right flexible linkage at a first end having a tooth mechanism which extends from a first right extension arm and ends in the tooth mechanism inserted into a ratchet notch of a right ratchet collar, the right extension arm then extends to a central pivot section with a central pivot opening which is inserted onto a right pivot pin, the pivot section then extends into a second right arm section which extends to a first stop tooth member of the second right arm section, and on the opposite side of the second right arm section has an arcuate extension which extends into a flat tooth member which is engaged by the trigger mechanism, the mechanical plate further including a left stop wall having a opening into which the first extension arm of the left linkage member is inserted and prevented from further transverse movement, and a second stop wall with an opening into which the arm of the right linkage member is inserted, the respective end tooth members of the respective linkages are retained by a stop member and are therefore restrained from further transverse movement, each opposite end which contains a respective tooth are respectively inserted into a gap in the trigger mechanism, the stop member serves to limit further advance of each flexible linkage and to give a spring effect to keep the linkages acting as a spring, the left linkage has the tooth of the left linkage inserted into a notch of the left notch collar and a tooth of the right linkage is inserted into a notch of the right notch collar, there is also a first compression spring and a second compression spring which respectively rest around first and second spring housing support posts, each compression spring is respectively retained in the underside of the top plate by respective post members and each respective spring is retained in the bottom of the stationary top plate, each ratchet collar respectively has a top opening on a respective top surface of each respective ratchet collar, so that when respective pins from the underside of the top plate are inserted into the openings of the left and right ratchet collar, the respective pins from the underside of the top plate respectively extend to the bottom surface of the collar and are retained by the TINNERMAN clips (mechanical fasteners) so that a travel distance that the push plate can make is a length of the distance from a respective widened top part of a pin to a top of an interior wall of a respective ratchet collar, and e. when assembled, the top plate is inserted into the mechanical plate by having the respective pins respectively inserted into respective notch collar openings of each respective notch collars and then the push plate is affixed by having each one so of the respective spring collars affixed to the bottom of the top plate and having the TINNERMAN clips (mechanical fasteners) respectively affixed onto a respective end of a respective one of the pins to affix the push plate to the bottom of the top plate with the mechanical plate between the top plate and push plate which is press fit retains a non-woven cloth wrapped around the push plate and retained by the hook member fasteners between the push plate and the mechanical plate and when the trigger is activated, a downward force of the springs cause the push plate to move away from the mechanical plate and the non-woven cloth is pulled away from the hook retaining members and is released.

3. A flat mop having a handle and apparatus for retaining the handle to a top plate of the flat mop, the flat mop comprising:

a. a top plate including a first cover member and a second cover member, a bottom surface further retaining a pair of spaced apart steel pins which are molded into the bottom surface respectively aligned with the first cover and the second cover;

b. a push plate having a bottom surface, a pair of spaced apart pin retaining members affixed to the bottom surface with access from the pin retaining members to the top surface of the push plate and respectively aligned with a respective steel pin the top surface of the push plate retaining a spaced apart pair of ratchet collars with a respective sidewall with each respective sidewall having a respective ratchet notch into which an end tooth of a linkage of a trigger mechanism will be engaged, each ratchet collar has a respective opening in a respective top, each opening respectively extending to interior shafts within each ratchet collar and extend through the interior shaft of each respective ratchet collar and extend out of the respective ratchet collar to the bottom surface of the push plate so that a respective one of the pins can be affixed to a respective bottom of one of the steel pins, the top surface of the push plate also has a pair of spring housings to respectively support a respective compression springs;

c. a mechanical plate with openings to receive the pair of ratchet collars and a pair of spring housings which extend through the mechanical plate from the push plate;

d. the mechanical plate having a left ratchet collar and a right ratchet collar and first and second spring housings from the push plate pushed through respective openings in the mechanical plate which also includes additional operating mechanical linkages including a left linkage having a first end which extends from a first extension arm and ends in a left tooth mechanism which is inserted into a first ratchet notch of a first ratchet collar, the arm then extends to a central pivot section with a central pivot opening which is inserted onto a left pivot pin, the pivot section then extends into a second left arm section which extends to a first stop tooth member on the second left arm surface and on the opposite side of the second left arm surface has an arcuate extension which extends into a flat tooth member which is engaged by a trigger mechanism, a right flexible linkage which is a mirror image of a left flexible linkage, the right flexible linkage at a first end having a tooth mechanism which extends from a first right extension arm and ends in a tooth mechanism inserted into a ratchet notch of a right ratchet collar, the right extension arm then extends to a central pivot section with a central pivot opening which is inserted onto a right pivot pin, the pivot section then extends into a second extension right arm section which extends to a first stop tooth member, and on the opposite side of the second right arm section has an arcuate extension which extends into a flat tooth member which is engaged by the trigger mechanism, the mechanical plate further including a left stop wall having a opening into which an arm of the left linkage member is inserted and prevented from further transverse movement, and a second stop wall with an opening into which the extension arm of the right linkage member is inserted, a respective end of each tooth member of the respective linkages are retained by a stop member and are therefore restrained from further transverse movement, each opposite end which contains a respective tooth are respectively inserted into a gap in the trigger mechanism, the stop member serves to limit further advance of each flexible linkage and to give a spring effect to keep the linkages acting as a spring, the tooth of the right linkage is inserted into a notch of the left notch collar and a tooth of the right linkage is inserted into a notch of the right notch collar, there is also a first compression spring and a second compression spring which respectively rest around a first and a second spring housing support posts, each compression spring is respectively retained in an underside of the top plate by respective post members and each respective spring is retained in the bottom of the stationary top plate, each ratchet collar respectively has a top opening on its top, so that when respective pins from the underside of the top plate are inserted into the openings of the left and right ratchet collar, the respective pins from the underside of the top plate respectively extend to the bottom of the collar and are retained by the TINNERMAN clips (mechanical fasteners) so that a travel distance that the push plate can make a the length of the distance from a respective widened top part of a pin to a top of an interior wall of a respective ratchet collar; and e. when assembled, the top plate is inserted into the mechanical plate by having the respective pins respectively inserted into respective notch collar openings of each respective notch collar and then the push plate is affixed by having each one of the respective spring collars affixed to the bottom of the top plate and having the pin retaining members respectively affixed onto a respective end of a respective one of the pins to affix the push plate to the bottom of the top plate with the mechanical plate between the top plate and push plate which press fit retains a cleaning cloth wrapped around the push plate and retained between the push plate and the mechanical plate and when the trigger is activated, a downward force of the springs cause the push plate to move away from the mechanical plate and the cleaning cloth is released.

* * * * *